US005085264A

United States Patent [19]

Jolivet et al.

[11] Patent Number: 5,085,264

[45] Date of Patent: Feb. 4, 1992

[54] PROCESS FOR ADJUSTING THE SECONDARY COOLING OF A MACHINE FOR CONTINUOUS CASTING OF METAL PRODUCTS

[75] Inventors: Jean-Marc Jolivet, Rurange-Lés-Thionville; Laurent Sosin, Serfmange, both of France

[73] Assignee: Irsid, Puteaux, France

[21] Appl. No.: 485,524

[22] Filed: Feb. 27, 1990

[30] Foreign Application Priority Data

Feb. 27, 1989 [FR] France ..... 89 2927

[51] Int. Cl.[5] ..... B22D 11/124; B22D 11/22

[52] U.S. Cl. ..... 164/455; 164/486

[58] Field of Search ..... 164/454, 455, 485, 486

[56] References Cited

U.S. PATENT DOCUMENTS

| | | | |
|---|---|---|---|
| 3,915,216 | 10/1975 | Fekette et al. | 164/455 |
| 4,073,332 | 2/1978 | Etienne | 164/455 |
| 4,169,498 | 10/1979 | Wilhelm | 164/455 |
| 4,460,033 | 7/1984 | Tsubakihara et al. | 164/455 |
| 4,463,795 | 8/1984 | Chielens et al. | 164/455 |
| 4,562,880 | 1/1986 | Larrecq et al. | 164/455 |
| 4,699,202 | 10/1987 | Gilles | 164/455 |

FOREIGN PATENT DOCUMENTS

| | | | |
|---|---|---|---|
| 59-199155 | 11/1984 | Japan | 164/455 |
| 60-49850 | 3/1985 | Japan | 164/455 |
| 61-74763 | 4/1986 | Japan | 164/455 |
| 63-235055 | 9/1988 | Japan | 164/455 |
| 111059 | 1/1989 | Japan | 164/455 |
| 0831299 | 5/1981 | U.S.S.R. | 164/455 |

*Primary Examiner*—Richard K. Seidel
*Assistant Examiner*—Rex E. Pelto
*Attorney, Agent, or Firm*—Pollock, Vande Sande & Priddy

[57] ABSTRACT

Process for secondary cooling of a metal product continuously cast on a machine in which secondary cooling is divided into n staggered independent zones, within which the flow of cooling fluid varies according to the speed of the product. An undesired change in the surface temperature of the product at a point HD of the metallurgical length of the machine, such as the straightening point, due to a foreseen or foreseeable variation starting at the time $t_{vo}$, in the casting speed, is compensated for by anticipation. A determination is made, by means of the casting speed, of the time $t_o$ at which commences, at the upper part of the ingot mold, the portion of product which, at the time tvo, will reach the point HD; a further determination is made of the times $t_1, \ldots, t_1, \ldots, t_n$ at which the portion commencing at $t_o$ will emerge from the zones 1, . . . . i. . . . ,n of the secondary cooling; and, from the time $t_{vo}$, the method of cooling conventionally used is recommenced, varying according to the actual speed.

2 Claims, 1 Drawing Sheet

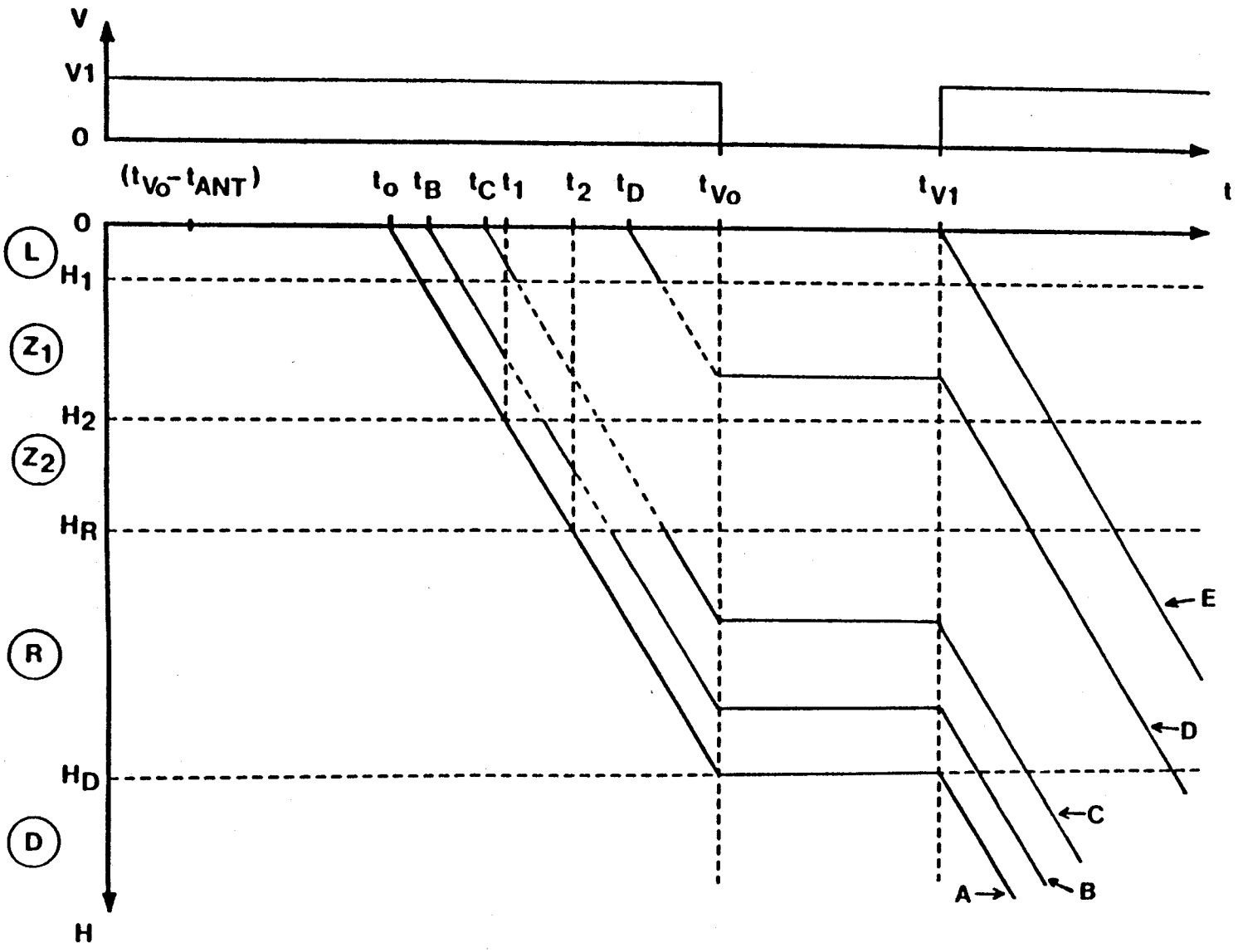
V
V1
0
t
$(t_{V_0}-t_{ANT})$
$t_0$ $t_B$ $t_C$ $t_1$ $t_2$ $t_D$ $t_{V_0}$ $t_{V1}$
E
D
C
B
A
0
$H_1$
$H_2$
$H_R$
$H_D$
H
L
$Z_1$
$Z_2$
R
D

PROCESS FOR ADJUSTING THE SECONDARY COOLING OF A MACHINE FOR CONTINUOUS CASTING OF METAL PRODUCTS

FIELD OF THE INVENTION

The invention relates to the adjustment of the secondary cooling of a machine for continuous casting of metal, particularly steel, products, such as slabs, blooms or billets.

More precisely, the invention relates to the adjustment processes of this type in which the future speed of advance of the product in the machine is taken into account in determining the intensities of cooling in the various zones of the machine.

BACKGROUND OF THE INVENTION

In a machine for continuous casting of metallurgical products, secondary cooling of the product is conventionally provided by ramps of jets which spray a cooling liquid, generally water optionally mixed with air, onto the product. Spraying of the product commences immediately below the ingot mold and can be continued until the product reaches the bending and extraction zone. However, most often, spraying is interrupted before the straightening zone.

Today, it is known that the final quality of the cast product is greatly influenced by the manner in which its secondary cooling has been conducted Good adjustment of the latter makes it possible, in particular

- to ensure complete solidification of the product before its straightening or its oxygen cutting;
- to ensure good mechanical behavior of the solidified skin along the machine and, in particular, to avoid the problems of bulging due to too high a surface temperature which can generate internal cracks and considerable central segregation;
- to ensure a certain uniformity in the cooling of the product and to avoid sudden reheating or cooling capable of creating cracks at the solidification front (internal cracks) or surface cracks;
- to maintain the surface temperature on straightening in the zone of good forgeability of the metal and to thus avoid the formation of transverse cracks on the undersurface.

Secondary cooling is conventionally divided into various successive spraying zones along the cast product. Within each of these zones, the flow of water can be adjusted independently of the other zones The production of a good-quality product is connected to a correct definition of the flows of water in the various zones, particularly in relation to the speed of casting, i.e., the speed of extraction of the product from the machine.

When the speed of casting is constant, the definition of a suitable secondary cooling method poses no problems. In the case of a small variation in the speed of casting, even if sudden, the cooling of the product deviates only relatively slightly from the ideal program defined for a continuous operation and the quality of the product is scarcely affected thereby This does not apply when the advance of the product passes through a major transition, corresponding to an increase or, above all, to a sudden and considerable reduction in the speed of casting, or even to stoppage of extraction.

When such a transition occurs, the product present in the machine has its cooling disrupted relative to the ideal foreseen program. This disruption particularly affects the portion of the product which, during this transition, is passing through the zone of the machine located between the end of secondary cooling and the straightening point. In this zone, the product cools naturally, particularly by means of radiation, without being sprayed. The transition in speed has the effect of modifying the residence time of the product in this zone of natural cooling. As the operators are no longer able to control the speed of cooling of this portion of the product, this portion reaches the straightening point at a temperature which is substantially different from that which it would have had if the speed of casting had remained normal. This phenomenon is particularly damaging when the speed of casting becomes low or zero during the transition. In fact, under these conditions, cooling of the product is accentuated and the latter reaches the straightening point at a temperature which risks being too low because it is situated outside the zone of good forgeability of the metal.

Such transitional phases occur unexpectedly when there are incidents connected with the operation of the machine. However, most frequently (in approximately 90% of the cases), they are connected with conventional and foreseeable operations, such as the completion of pouring, or a change of distributor.

DESCRIPTION OF THE PRIOR ART

Applicants' European Patent EP. 0116496, in the name of the Applicant, describes a process of anticipatory secondary cooling. For spraying the product in the various zones of secondary cooling, this process takes into account not only the present and past speeds of advance of the product, as performed to date, but also its future speed of advance when it is possible to predict at which moment a transition will commence, what its duration will be and what will then be the speed of advance This is achieved by introducing temporarily into the adjustment system, in place of the actual extraction speed, a "decoy" speed which is between the actual speed and the future speed. It is thus possible to tend to compensate by anticipation for the supplementary cooling which will be obtained by a slowing down or stoppage of the extraction, by reducing the cooling of the product even before the variation in the speed of casting has taken place. A similar argument may be followed if a sudden increase in speed of casting is foreseen: the intensity of cooling must then be increased in advance and the fictitious speed must be greater than the actual speed and lower than the future speed.

This process is well suited to those cases in which the variation in speed is not too great or occurs progressively. However, in the case of a marked transition, such as a sudden stoppage of extraction, action in respect of secondary cooling may not be quick enough to sufficiently limit the fall in temperature of the product In fact, it is undesirable to impose, when beginning the operation of anticipation, a very low fictitious speed which would be well suited to the sections which will be subject to the transitional operation, but which would excessively disrupt the cooling of the portions of the product which are currently being cast and which will not be affected by this transition.

SUMMARY OF THE INVENTION

The invention aims to propose a method for adjusting the secondary cooling which also operates by anticipating those events which will lead to changes in the speed of casting, but which would be more suitable than existing methods in the case of transitional operations leading to sudden and considerable variations in this speed.

To this end, the subject of the invention is a process for secondary cooling of a metal, particularly steel, product, such as a slab, a bloom or a billet, which is continuously cast on a machine whose secondary cooling is divided into n staggered independent zones, within which a flow of cooling fluid, varying according to the speed of casting of the product, is sprayed on the said product, in which process an undesired change in the surface temperature of the product at a point HD of the metallurgical length of the machine, such as the straightening point, beyond which it is no longer desired to control the temperature of the product, is compensated for by anticipation, this change in temperature being due to a foreseen or foreseeable variation in the speed of casting commencing at the time $t_{vo}$, in which process:

- a determination is made, by means of the speed of casting, of the time $t_o$ at which commences, at the upper part of the ingot mold, the portion of product which, at the time $t_{vo}$, will reach the point HD,
- a determination is made of the times $t_1,...t_i,...t_n$ at which the portion of product commencing at $t_o$ will emerge from the zones 1,...i,...n of the secondary cooling,
- from the time $t_1$, a flow of cooling fluid adapted to the compensation for the said change in temperature is imposed in the zone i,
- and, from the time $t_{vo}$, the cooling method conventionally used on the machine is recommenced, varying according to the actual speed of casting.

As will be understood, the invention consists in applying to the portions of product affected by the transitional operation a specific cooling which is independent of the present speed of casting and which is intended to compensate for the increase or the lack of cooling of these portions which would otherwise result from the transition. This specific cooling is not applied immediately throughout the machine, but it is implemented successively in the various zones of secondary cooling. This makes it possible to adapt the method of cooling of a given portion of product more precisely to the history of its path than do the prior art methods.

DESCRIPTION OF THE PREFERRED EMBODIMENT

The invention will be better understood on reading the following description which is given with reference to the appended single figure. The single figure is composed of two diagrams having an abscissa axis in common. The top diagram shows the evolution, during the time t, of the speed of casting V. In the example described, this speed assumes a constant and non-zero value V1 up to a time $t_{vo}$, when it becomes zero following an event such as a change of distributor. It remains zero up to a time $t_{V1}$, when it reassumes the preceding value V1.

The curves A, B, C, D, E in the bottom diagram represent the path, in the machine during the time t, of the extremely thin product portions, called sections, which commence at various times, $t_o$, $t_B$, $t_C$, $t_D$, $t_{V1}$ at the upper part of the ingot mold. The ordinate of a point of one of these curves represents the point in the machine H at which the corresponding section is located at the time plotted on the abscissa. The length of the machine is divided into several zones through which the product passes successively;

- the ingot mold, denoted L on the diagram, extending from the point 0 to the point H1,
- the first zone of secondary cooling, denoted Z1, extending from the point H1 to the point H2,
- the second zone of secondary cooling, denoted Z2, extending from the point H2 to the point HR,
- a zone in which the product is not sprayed and is cooled naturally by radiation, denoted R, extending from the point HR to the point HD,
- the straightening zone, denoted D, which commences at the point HD, referred to as the "straightening point".

It is considered that, in the zone D, the method of cooling of the product no longer has an influence on the quality of the product and it is no longer attempted to control it.

The anticipatory secondary cooling operation is achieved in the following manner. At the time ($t_{Vo}$—$t_{ANT}$), the operator responsible for the functioning of the machine is alerted to the fact that, at the time $t_{Vo}$ which is still in the future, some event will oblige him to interrupt the extraction of the product which will not recommence until the time $t_{V1}$. The operator (or computer which preferably manages the secondary cooling) then determines the time $t_o$ corresponding to the commencement, at the upper part of the ingot mold (that is to say at the point 0), of the extremely thin section of product which, at the time $t_{Vo}$, will be located at the point HD, that is to say at the bending point. The sections commencing after $t_o$ will thus not yet have arrived at the straightening point when stoppage of extraction commences and it is these which will be subject to a modified secondary cooling.

To this end, the time $t_1$ at which the section commencing at t will emerge from the zone Z1 is determined. From the time $t_1$, a predetermined minimum flow of water is applied in the zone Z1. This minimum flow can be zero flow, the technological minimum attainable on this zone 1, or a previously defined minimum flow which is different from the two preceding flows. This flow is maintained constant throughout the anticipation phase extending from $t_1$ to $t_{Vo}$. The choice of the minimum flow is determined before casting. It must comply with the safety constraints of the continuous casting machine and be adapted to the compensation for the change in temperature of the product at the straightening point which would be caused by the stoppage of extraction. Generally, the times $t_i$ are determined, i being an integer less than or equal to the number n of zones of secondary cooling, at which times the section commencing at t will emerge from the various zones Zi. After $t_i$, a predetermined minimum flow of water, as has just been defined, is applied in Zi. This minimum flow may be different in each zone. In the case illustrated, the number n of zones of secondary cooling equals 2, but it may, of course, assume any greater value. At the time $t_{Vo}$, this procedure is interrupted and use of the cooling method conventionally employed on the machine in the case of stoppage of extraction is recommenced, then the latter is restarted.

Two cases may be envisaged:

it is foreseen at ($t_{Vo}-t_{ANT}$) that the extraction will be stopped at $t_{Vo}$, and that the time $t_o$, deduced from this forecast, is still to come. In this case, the procedure of secondary cooling by anticipation will affect all the sections commencing between $t_o$ and $t_{Vo}$, as has just been described.

at the time ($t_{Vo}-t_{ANT}$), stoppage of extraction at $t_{Vo}$ is foreseen, whereas the time t deduced from this forecast is already past. The procedure of secondary cooling in advance is then immediately set in motion. If the time $t_j$ is the last of the times t to have been past, the very first sections of product already cast will have been subject to normal cooling in at least one part of the zone j and of the preceding zones and not to a cooling according to the invention. They thus risk being, at the straightening point, at a temperature located outside the desired range. Nevertheless, even late application of the procedure of secondary cooling by anticipation will have made it possible to cast a greater length of the product under satisfactory conditions as compared with the case in which no specific action had taken place in respect of cooling The single figure illustrates the case in which it has been possible to forecast stoppage of extraction before the time $t_o$. The various portions of the curves A, B, C, D, E are plotted in solid lines for the time intervals in which the section which they represent has been sprayed according to conventional procedures (corresponding to V=V1 before $t_{Vo}$ and after $t_{V1}$, and at V=0 between $t_{Vo}$ and $t_{V1}$), and in dotted lines for the time intervals in which they have been subjected to minimum spraying, following the anticipation procedure. It should be noted that, in this example, cooling of the portion of product present in the ingot mold is not modified during the anticipation procedure The section commencing at t (curve A) is subject, like the previous ones, to cooling of the conventional type over its entire path The section commencing at $t_B$ (curve B) is subject to minimum spraying as it finishes crossing the zone Z1 and as it finishes crossing the zone Z2. The section commencing at $t_C$ (curve C) is subject to minimum spraying throughout its passage through the secondary cooling zone. The section commencing at $t_D$ (curve D) is subject to minimum spraying between its entry into the zone Z1 and the time $t_{Vo}$ when it is stationary within Z1. The section commencing at $t_{Vo}$ (curve E) remains at the point 0 throughout the entire duration of the stoppage of extraction and is the first section, since that commencing at $t_o$, to be subject over its entire path to cooling according to conventional procedures, firstly for V=0 and then for V=V1.

A similar argument could apply in the case where the instantaneous modification of the speed of casting would not be a stoppage of extraction, but a simple slowing down.

A significant aspect in the implementation of a model of the type according to the invention is the forecasting, with a sufficient degree of certainty, of the time $t_{Vo}$ at which the transitional operation will commence. If this time in fact occurs substantially later than had initially been foreseen, considerable portions of the product will have meanwhile been subject to too little cooling. This risks bringing these portions of product to the straightening point in a state of insufficiently advanced solidification. which can give rise to the formation of defects during bending.

The consequences of this difficulty can be limited if the operator allocates a degree of certainty "CERT" to the forecasting of the time $t_{Vo}$, CERT is firstly assumed equal to 0 when forecasting is still uncertain, and to 1 when $t_{Vo}$ can be determined with certainty.

According to this alternative embodiment of the model, while CERT equals 0, only the end zone or zones of secondary cooling (for example the zones 5 and 6 if it has 6 zones) will be subject to the minimum of flow throughout the anticipatory cooling procedure. These zones are, in fact, those in which urgent action is most required, since the portions of product located therein will be the first to enter into the zone R in which no further action will be possible If, finally, the transition does not take place, or does not commence at $t_{Vo}$ but at a later time, these portions will have been subjected to unsuitable cooling only in the final zone or zones, and the effects on the quality of the product will be less than if cooling had been unsuitable in all the zones.

When the operator becomes certain that the transition will indeed commence at $t_{vo}$, he imposes CERT=1 on the model. Then, all secondary cooling can take place according to the procedure described above.

If, on the other hand, the operator learns at the time ($t'_{Vo}$-$t'_{ANT}$) after ($t_{Vo}$-$t_{ANT}$), that the transition will commence at the time $t'_{Vo}$, which is different from $t_{Vo}$, with a degree of certainty CERT', the anticipation procedure which was in force is immediately interrupted. It is immediately replaced by a procedure based on the new data which reached the operator at the time ($t'_{Vo}$-$t'_{ANT}$).

The process according to the invention can also be applied to straight continuous casting in which the product does not need to be unbent. In the above argument, the straightening point will then replaced by the point at which the product is cut, or more generally by any point beyond which it is estimated that the method of cooling the product no longer has an influence on its quality.

We claim:

1. In a process for cooling a metal product during casting of said product in a continuous casting machine, said process comprising the steps of (a) in a bottomless ingot mold defining a size of said product, primary cooling metal in a liquid state, producing a solidified outer shell surrounding a liquid core of said product;

(b) secondary cooling by applying a flow of cooling fluid to a free surface of said outer shell of said product in a secondary cooling section beginning immediately below said ingot mold and extending on a portion of a metallurgical length of said machine, said secondary cooling section being divided into n staggered independent zones within which said flow of said cooling fluid varies according to a casting speed of said product;

(c) after said secondary cooling section, allowing said product to cool naturally until it is completely solidified;

(d) selecting a point HD of said metallurgical length of said machine, located downstream of said secondary cooling section, beyond which it is no longer desired to control a temperature of said product; and (e) compensating for an undesired change in surface temperature of said product at said point HD by applying anticipatory secondary cooling, said change in surface temperature being due to a modification in casting speed of casting commencing at a time $t_{Vo}$ which is still in the future, said anticipatory secondary cooling consisting in modifying the flow of cooling fluid in different said independent zones of said secondary cooling section; the improvement consisting of:

(f) determining, by means of the speed of casting, a time $t_o$ at which commences, at the upper part of the ingot mold, a portion of product which, at said time $t_{Vo}$, will reach said point HD;

(g) determining times $t_1, \ldots t_i, \ldots t_n$ at which the portion of product commencing at $t_o$ will emerge from zones 1, . . . i, . . . n of said secondary cooling section;

(h) imposing in said zone i, from time $t_i$, a flow of cooling fluid adapted to compensate for said change in temperature; and (i) from said time $t_{Vo}$, using again a cooling method in which flows of cooling fluid in said n zones of said secondary cooling section vary according to the actual speed of casting of said product.

2. Process according to claim 1, including (a) allocating a degree of certainty "CERT" to forecasting of said time $t_{vo}$, CERT being equal to 0 while said forecasting is uncertain, and CERT being equal to 1 from the moment when said forecasting becomes certain;

(b) applying said anticipatory secondary cooling procedure only in at least one final zone of said secondary cooling section while CERT is equal to 0; and (c) applying said anticipatory secondary cooling procedure throughout the entire secondary cooling section when CERT is equal to 1.

* * * * *

UNITED STATES PATENT AND TRADEMARK OFFICE

CERTIFICATE OF CORRECTION

PATENT NO. : 5,085,264

DATED : February 4, 1992

INVENTOR(S) : JOLIVET, ET AL.

It is certified that error appears in the above-identified patent and that said Letters Patent is hereby corrected as shown below:

On the title page, Item [75] "Serfmange" should read --Seremange--

Signed and Sealed this

First Day of September, 1992

*Attest:*

DOUGLAS B. COMER

*Attesting Officer*

*Acting Commissioner of Patents and Trademarks*